US008371143B2

(12) United States Patent
Ragner

(10) Patent No.: US 8,371,143 B2
(45) Date of Patent: Feb. 12, 2013

(54) HOSE REINFORCEMENT KNITTING MACHINE AND KNITTING PROCESS

(75) Inventor: Gary Dean Ragner, Gainesville, FL (US)

(73) Assignee: Ragner Technology Corporation, Gainesville, FL (US)

( * ) Notice: Subject to any disclaimer, the term of this patent is extended or adjusted under 35 U.S.C. 154(b) by 0 days.

(21) Appl. No.: 13/402,865

(22) Filed: Feb. 22, 2012

(65) Prior Publication Data

US 2012/0210752 A1 Aug. 23, 2012

Related U.S. Application Data

(60) Provisional application No. 61/463,725, filed on Feb. 22, 2011.

(51) Int. Cl.
*D04B 9/44* (2006.01)

(52) U.S. Cl. ..... 66/9 A

(58) Field of Classification Search ..... 66/7, 8, 66/9 A, 80, 83, 170
See application file for complete search history.

(56) References Cited

U.S. PATENT DOCUMENTS

| | | | | | |
|---|---|---|---|---|---|
| 88,888 | A | * | 4/1869 | Mayall | 156/393 |
| 1,972,756 | A | * | 9/1934 | Blaisdell | 28/169 |
| 2,732,884 | A | * | 1/1956 | Vanzo | 156/393 |
| 2,752,952 | A | * | 7/1956 | Dauphinais | 138/125 |
| 3,201,954 | A | * | 8/1965 | Greczin | 66/9 R |
| 3,257,828 | A | * | 6/1966 | Greczin | 66/38 |
| 3,543,280 | A | * | 11/1970 | Greczin | 66/9 A |
| 3,760,606 | A | * | 9/1973 | Greczin | 66/9 A |
| 4,259,991 | A | * | 4/1981 | Kutnyak | 138/127 |
| 5,309,738 | A | * | 5/1994 | Morris | 66/132 T |
| 5,520,018 | A | * | 5/1996 | Wood | 66/9 A |
| 5,575,162 | A | | 11/1996 | Gray et al. | |
| 5,913,959 | A | * | 6/1999 | Klein et al. | 87/44 |
| 6,381,993 | B1 | | 5/2002 | Daiber | |
| 6,834,517 | B1 | * | 12/2004 | Sheehy, Jr. | 66/132 T |
| 7,647,946 | B2 | * | 1/2010 | Mirmand et al. | 138/110 |
| D642,245 | S | * | 7/2011 | Mezzalira et al. | D23/266 |
| D642,246 | S | * | 7/2011 | Mezzalira et al. | D23/266 |

* cited by examiner

*Primary Examiner* — Danny Worrell

(57) ABSTRACT

A circular knitting machine (140*b*) for knitting a plurality of yarns (196) into a tubular reinforcement (45) on a rotating hose (41), comprising a knitting head (160*b*) having a plurality of knitting needles (170 and 170*a*) and a central passageway, wherein the rotating hose is designed to pass through the central passageway, and rotate in the same direction as the knitting head. Further comprising a conforming means defined on the circular knitting machine for conforming the knitted reinforcement to the exterior of the rotating hose.

21 Claims, 7 Drawing Sheets

(Knitting Head Faster Than Hose)

(Knitting Head Slower Than Hose)

(Hose and Knitting head Same Speed)

HOSE REINFORCEMENT KNITTING MACHINE AND KNITTING PROCESS

CROSS-REFERENCE TO RELATED APPLICATIONS

This utility application claims priority from U.S. Provisional application Ser. No. 61/463,725, filed on Feb. 22, 2011, titled: "Hose Reinforcement Knitting Machine and Knitting Process".

BACKGROUND OF INVENTION

The field of this invention relates to manufacturing equipment and methods for making and reinforcing hoses and more specifically reinforcing hoses with a circular weft knit to resist internal pressures within the hose.

The present state of the art of knitting comprises many different kinds of knitting machines. They are broadly classified as one of two types "Flat Knitting Machines" and "Circular Knitting Machines". Each type of knitting machine has many variations for various types of textiles. The Flat Knitting Machines generally have a straight knitting bar that knits one or more yarns into a flat textile sheet. The Circular Knitting Machines have a circular knitting head and knit a tube shaped textile that can be cut into a flat sheet if desired. Both the Flat and Circular knitting machines are designed for many different knit patterns which can be classified as either a Warp Knit (yarn runs longitudinally with the fabric's length) or Weft Knit (yarn runs transverse to the fabric's length). Circular weft knitting machines are use for making socks, undershirts, and other tubular fabric including reinforcement and covers for hoses. Circular weft knitting machines are also used for general fabric production because of the limited number of yarn spools needed to begin production. Weft knitting machines can produce fabric with as little as one yarn strand, but may use many dozens of yarn strands. Warp knitting machines, on the other hand, generally have many thousands of individual yarn strands that run lengthwise along the fabric and are all knitted together to form a fabric.

The first circular weft knitting machines where single yarn devices, where the yarn would be pulled from a single spool and moved around the circular knitting head to allow it to engage all the knitting needles and form the tubular knitted product. Neither the knitting head, produced fabric nor the yarn packages rotated around the axis of the knitting machine. However, to increase speed, additional yarn strands were soon used, which made it necessary to do one of two things. Either the yarn packages needed to rotate around the knitting head to feed yarn to the knitting needles (so the yarns did not tangle), or the knitting head and produced fabric must rotate together to allow the yarn packages to remain on stationary racks. The disclosed invention fits in this last category, where the yarn packages or spools are stationary, and the knitting head and knitting needles rotate to produce a rotating tube shaped fabric.

Figure 1:
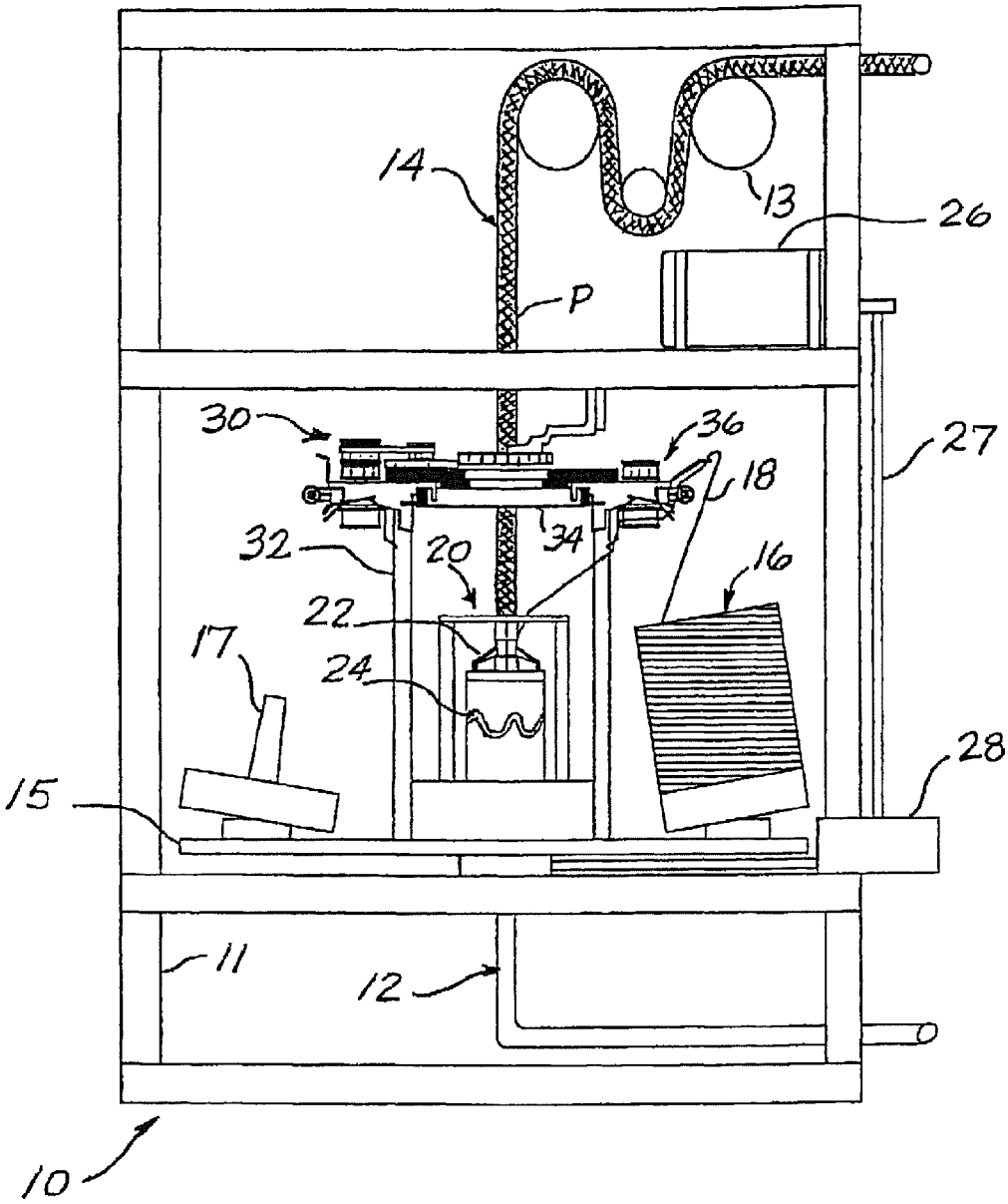
Fig. 1 Prior Art

Prior Art circular knitting machines for knitting reinforcement on hoses appears to be confined to knitting machines for reinforcing non-rotating hoses. In FIG. 1, we see a typical prior art circular knitting machine, U.S. Pat. No. 6,834,517 for a "Yarn Feeding System" issued to Sheehy, Jr. FIG. 1 of the specifications show a yarn feeding system for a typical circular weft hose knitting machine. Knitting machine 10 provides a rotatable deck 15 which rotates multiple yarn packages 16 around knitting head 20 to feed yarn 18 to knitting needles 22. Knitting head 20, hose 20 and needles 22 do not rotate to knit reinforcement P on hose 12 and thus knitting head 20 matches speed with hose 12. The rate at which hose 12 is pulled through knitting head 20 determines the rate at which knitting machine 10 can provide a tightly knitted cover for hose 12 and produce reinforced hose 14. In operation, roller 13 pulls hose 12 through knitting head 20 from the top. Yarn packages 16 rotate at high speed around knitting head 20, while feeder head assembly 30 draw in yarn and direct it to knitting needles 22. Through weft knitting action a circular knit is produced around hose 12 and is tightened around hose 12 to provide reinforcement. In this hose wrapping design by Sheehy and other similar prior art hose wrapping circular weft knitting machines a non-rotating hose is pulled through the knitting machine. Thus, neither are the knitting head nor knitting needles are rotating as the hose reinforcement is knitted over the hose. However, to use more than one yarn spool requires that the yarn spools rotate around the knitting head, at high speed, to feed yarn to the knitting needles and producing the weft knit. This greatly increases the complexity of the circular knitting machine and adds cost. Nearly eighty percent of the equipment weight for these machines is associated with the need to rotate the yarn spools deck 15 at high speed. The Applicant's circular knitting machine eliminates this rotatable deck and with it much of the cost of the machinery.

To get around having to rotate the yarn spools at high speed, some systems like the circular knitting machine 100 seen in U.S. Pat. No. 6,381,993 B1 issued to Hermann allows many stationary yarn spools to be used by rotating his Knitting Cylinder and Dial (circular knitting head). This creates the problem when making a knitted tube, which is the problem of collecting a rotating knitted article. Thus to collect the knitted fabric on the take-up roller (see roller 135 in Hermann) the roller must rotate with the knitting cylinder (see knitting cylinder 111 in Hermann). Similar, but larger diameter knitting machines like U.S. Pat. No. 5,575,162 issued to Gray are also used rotating collection mandrel 22 to collecting knitted fabric on a roller or spool. Gray's device ones like it rotate much too slowly because of their size and would not be appropriate for the purposes of reinforcing a hose, and like Hermann, still has the problem in how to rotate the hose with their system (hose rotation on both sides of a prior art circular knitting machine). The Applicant's circular knitting machine does not need a rotating take-up roller and assembly like Gray shows, nor does it need a rotating deck of yarn spools like Sheehy shows. Both of these types of systems, found in the prior art, are not needed by the Applicant's knitting machine, because the reinforcement go directly on a rotating hose that is being manufactured. This elimination of the weight associated with turning a fabric take-up roller, and elimination of a large rotating deck, greatly reduces the cost of the Applicant's system compared to the prior art. For knitting reinforcement around a hose, all prior art hose knitting and wrapping machines that were found required the hose not to rotate and required a large rotating deck of yarn spools. Thus, The applicant's device eliminates a very costly and dangerous component of prior art hose reinforcement machinery.

SUMMARY

In the production of stretch hoses, spiral laminated hoses, and other continuously wound hoses, the production process requires that the hose be rotating along its longitudinal axis (axially rotating) during manufacturing. The rotation allows strips of material to be wound quickly on the hose in a continuous manner. If reinforcement is desired for these hoses, it is knitted or wrapped on the hose in a secondary process after the hose has been made. The disclosed invention allows this reinforcement to be knitted onto the rotating hose during production of the hose. This allows a continuous inline process which removes the extra work required to transport, store, and reprocess the hose. It also allows multiple layers of reinforcement and polymers to be added in the same process. This allows inline production of a reinforced stretch hoses and other reinforced spiral wrapped hoses and significantly reduces the number of steps needed to produce a complete hose. Until now, knitted hose reinforcement has always been done on non-rotating hose stock. The hose would be fed into the knitting machine either from a reel, or during extrusion manufacturing of a non-rotating hose, which then passes through the circular knitting head. After the reinforcement is knitted onto the hose, the hose can be collected on a reel or go on to further processing. A hose knitting process like this requires a large rotating knitting structure where the yarn packages must rotate around the hose at high-speed to knit the reinforcement. These large rotating circular knitting machines have many disadvantages. First, they are expensive because of their large size, large weight and high speed rotation (requires a large containment structure for safety). Second, their yarn holding capacity is limited and they must be stopped frequently to be reload with yarn (a time consuming process). Third, they are not compatible with rotating hose production lines. In Prior Art rotating hose production lines the hose is first made and cut to length before being sent through a prior art circular knitting machine. Thus, the reinforcement process is a secondary process and any additional processing of the hose becomes a tertiary process.

Use of the presently disclosed invention eliminates the above mentioned weaknesses. First, the knitting equipment is inexpensive since the yarn packages can remain stationary during operation (circular weft knitting heads the needles rotate). This means there are no large rotating structure to increase cost of the equipment and increase power requirements. Second, because the yarn packages are stationary they can be placed on simple racks and one spool can be joined to the next so that continuous operation is possible. This saves the time needed to reload prior art circular hose knitting machines, and the down-time associated with it. Third, The disclosed invention is designed to work inline with rotary hose production equipment, allowing the reinforcement to be knitted on the rotating hose during production and allows additional coatings to be wrapped on after the reinforcement. This reduces worker handling and storage of partially finished hoses.

The disclosed invention provides hardware for providing the functions of knitting reinforcement over the exterior of a rotating hose and also defines a process for achieving this function. The process comprises the following steps: a) accepting a axially rotating hose into a circular knitting head, wherein the circular knitting head rotates in the same direction as the axially rotating hose and is fed yarn from yarn packages that are substantially stationary, b) knitting a fabric reinforcement tube around the axially rotating hose with the circular knitting machine, and c) conforming the fabric reinforcement to the exterior shape of the axially rotating hose.

To accomplish the above process, the disclosed circular knitting machine modifies existing circular knitting machines to knit a hose reinforcement onto a rapidly rotating hose, wherein the axial rotation of the hose is along the hose's longitudinal axis. Generally, the invention can be used in combination with other hose production equipment that rotates the hose during manufacturing. For example, hoses that are constructed by wrapping a strip of material around a rotating mandrel and adjacent edges of the strip are bonded together to form a sealed hose. The strip of material can be provided by a number of means including, but not limited to, providing pre-formed strips on spools, providing an extruded strip, and other methods. The extrusion of molten plastic onto a helical spring wire is common in the production of stretch hoses in the vacuum cleaner industry. This stretch hose structure has a convoluted shape, which means the stretch hose has a helical valley and helical ridge that spiral around each other along the length of the hose.

The disclosed invention accomplishes the process of knitting reinforcement with a specially designed circular knitting machine comprising, a rotating knitting head, a stationary cam system, a stationary yarn feeding system for feeding yarn from rack mounted yarn spools. The circular knitting machine uses a circular weft knitting head which is driven by a motor to rotate in the same direction as the rotation of the hose being reinforced. This rotation allows the knitting needles on the circular knitting head to pull yarn into the needles from stationary yarn spools and yarn feeding assemblies. The circular weft knitting head can comprise any of hundreds of different styles and arrangements for circular knitting machines which could provide a nearly unlimited range of knit patterns for reinforcing the hose. In general, the preferred knits would be a Jersey knit or plain knit for wrapping hose since these are the simplest and often the fastest to knit. A lock stitch (sometimes called a drop stitch) is also preferred, especially when high-speed is desired. Because the lock stitch drops every other needle the cam angle can be reduced in half, which allows the circular knitting head to rotate twice as fast without over stressing the needles. However, the invention is not limited to any particular knit or circular knitting head, since most knits styles can be used in various reinforcement situations.

DEFINITIONS

Within this document a number of technical terms will be use that have specific meanings. The meanings of these words are outlined below for use in the Specifications and the Claims.

LONGITUDINAL—The long direction on a fabric sheet or hose. Is also the direction the fabric or hose is produced. The longitudinal direction for a fabric is perpendicular to its width.

YARN—A textile material formed by one or more fibers of natural or man-made materials brought together to form a single strand of material.

WARP—A general term referencing the direction in a knit or weave that is parallel with the length or longitudinal direction of the fabric produced. It is the direction in which the fabric is produced and wound on a roll.

WEFT—A general term referencing the direction in a knit or weave that is perpendicular to the length or longitudinal direction of the fabric produced. It is the transverse direction across the produced fabric.

WARP KNITTING—The process of knitting adjacent longitudinal yarns together along the length of a fabric.

WEFT KNITTING—The process of knitting yarn together in the transverse or width-wise direction of the fabric being knitted. Yarn strand(s) run perpendicular to the fabric production direction.

CIRCULAR WARP KNITTING MACHINE—A knitting machine having at least one circular array of knitting needles designed for knitting one or more knit patterns with yarn supplied by a yarn feeding system. Each yarn is supplied to one or more specific needles within the circular array of needles for knitting. In this type of machine the yarn is knitted into the fabric parallel to the direction of the fabric production (fabrics longitudinal direction).

CIRCULAR WEFT KNITTING MACHINE—A knitting machine having at least one circular array of knitting needles designed for knitting one or more knit patterns and a yarn feeding system for feeding yarn around the circular array(s) and to the needles for knitting. In this type of machine the yarn is knitted into the fabric perpendicular to the direction of the fabric production (fabric's longitudinal direction).

CIRCULAR KNITTING HEAD or KNITTING HEAD—A collection of devices that comprise a circular array of knitting needles mounted within a plurality of needle guides or tracks, a collection of actuators for moving the needles at the proper time and in the proper way to perform the knitting process, and a support structure for mechanically connecting its components together and allowing for relative motion between its components.

OBJECTIVES AND ADVANTAGES

Accordingly, several objects and advantages of my invention are:

a) To provide a hose reinforcing system that can knit reinforcement onto a rotating hose to allow continuous production of a reinforced convoluted hose (helical hose).

b) To provide a hose reinforcing system that can knit reinforcement on a rotating hose while allowing the yarn spools to be mounted on a stationary rack.

c) To provide hose reinforcement without the need for rotating yarn spools.

d) To provide a hose knitting machine with a stationary cam system and rotating knitting head and knitting needles.

e) To provide a shaped hold down ring for conforming the knit into a convoluted shape.

f) To provide a continuous hose making production line comprising a convoluted stretch hose making machine for making a rotating stretch hose, a hose reinforcement knitting machine for knitting reinforcement over the rotating stretch hose, and an a convoluted hose coating device for bonding an outer polymer layer over the rotating reinforced hose.

DRAWING FIGURES

FIG. 1 Prior Art example of a circular weft hose knitting machine. Knitting machine 10 is designed to knit a reinforcing cover on hose 12.

Figure 2:
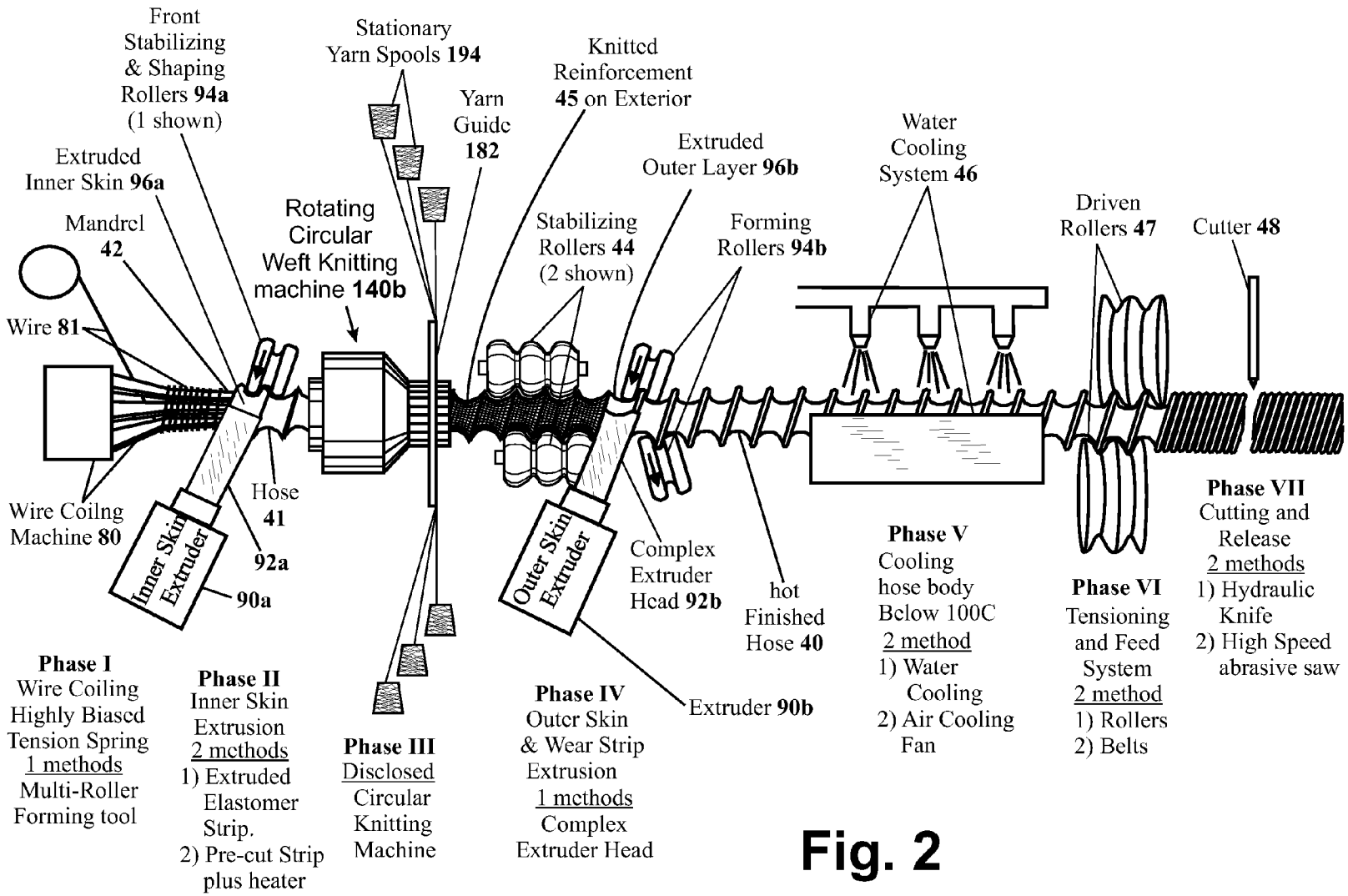

FIG. 2 Disclosed circular knitting machine shown in an example production line for making a reinforced stretch hose.

Figures 3, 3A, 3B, 3C:
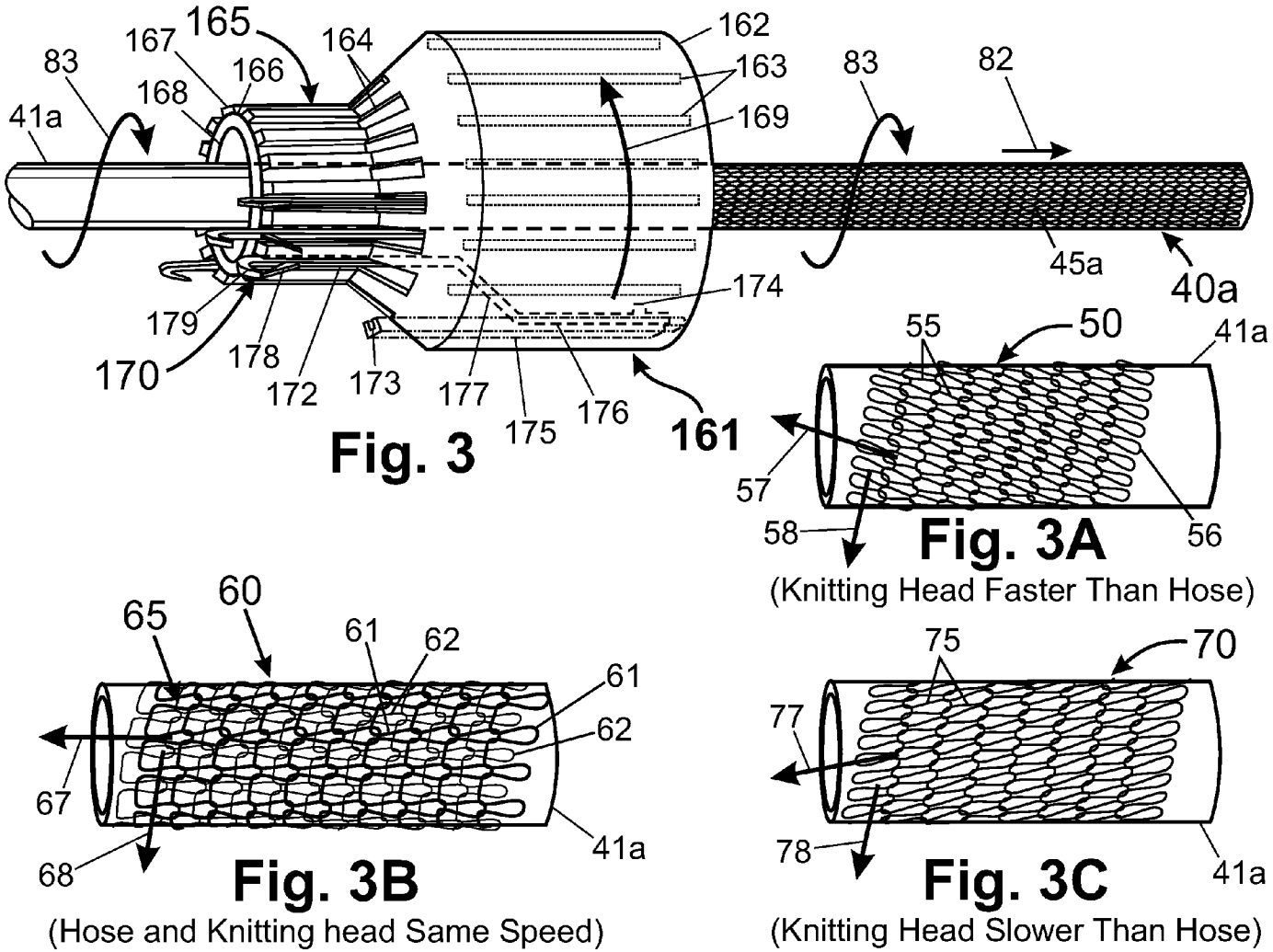

FIG. 3 Perspective view of the Disclosed Outer Cylinder Knitting Head Housing 161. Some of the knitting needles and yarn feed systems have been removed to show the structure more clearly. (The plain knit shown here can be produced by rotating the knitting head at approximately the same speed as the hose is rotating).

FIG. 3A Hose with plain weft knit reinforcement from the disclosed rotating weft circular knitting machine 140*a* (Knit shown can be produced by rotating the knitting head 161 faster than hose is rotating).

FIG. 3B Hose with a lock stitch weft knit reinforcement from the disclosed rotating weft circular knitting machine 140*a*. The lock stitch is sometimes called a Drop Stitch because a particular yarn strand skips or floats pass one or more needles during knitting. (Knit shown can be produced by rotating the knitting head at approximately the same speed as the hose is rotating during knitting).

FIG. 3C Hose with plain weft knit reinforcement from the disclosed rotating weft circular knitting machine (Knit shown can be produced by rotating the knitting head slower than hose is rotating).

Figure 4:
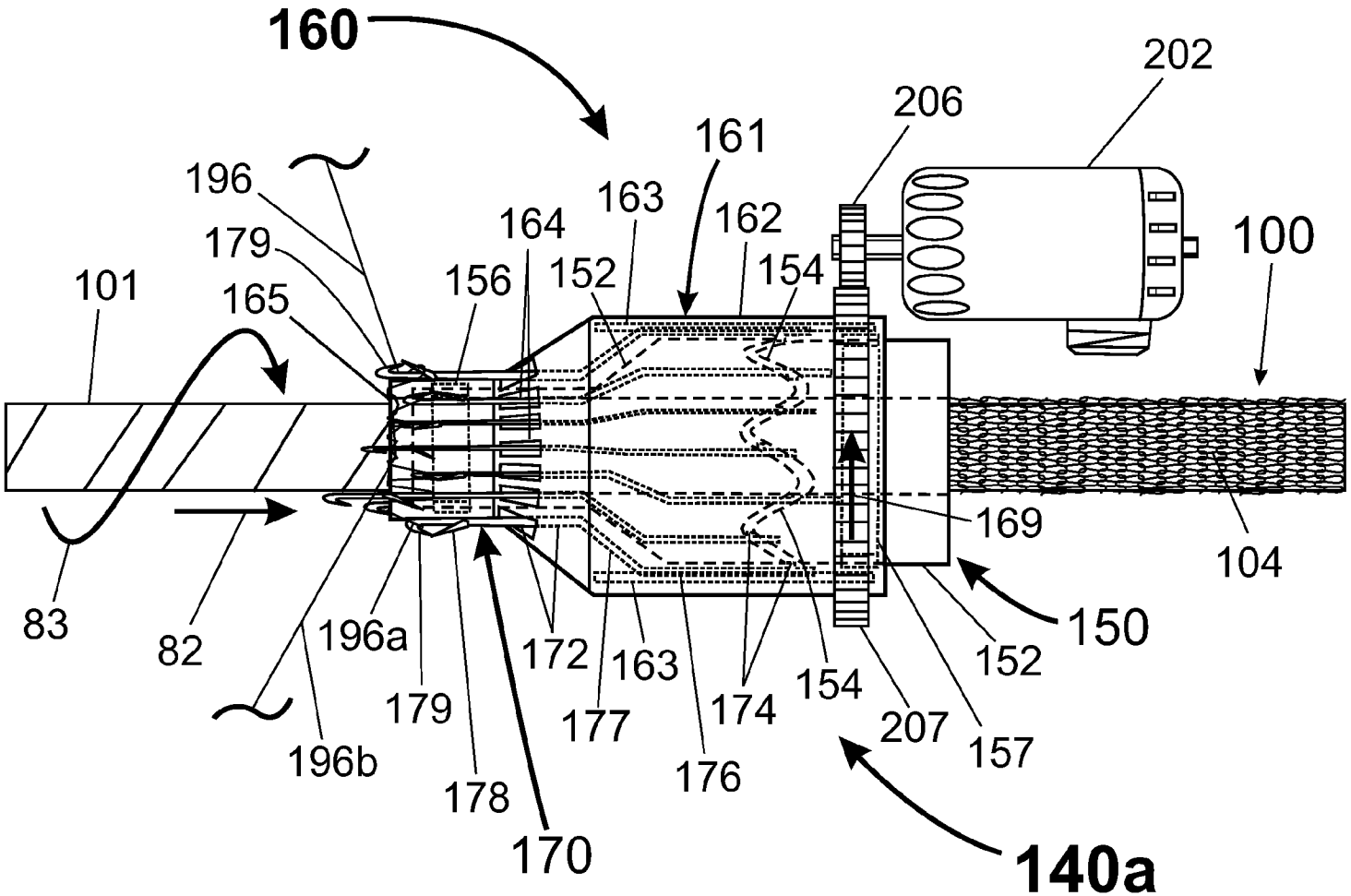

FIG. 4 Side view of the disclosed rotating weft knitting machine 140*a* using the outer knitting head housing 161 seen in FIG. 3. Knitting head 140*a* shows the internal cam guide for the knitting needles, knitting head motor, and knitting yarn positioning.

Figure 5:
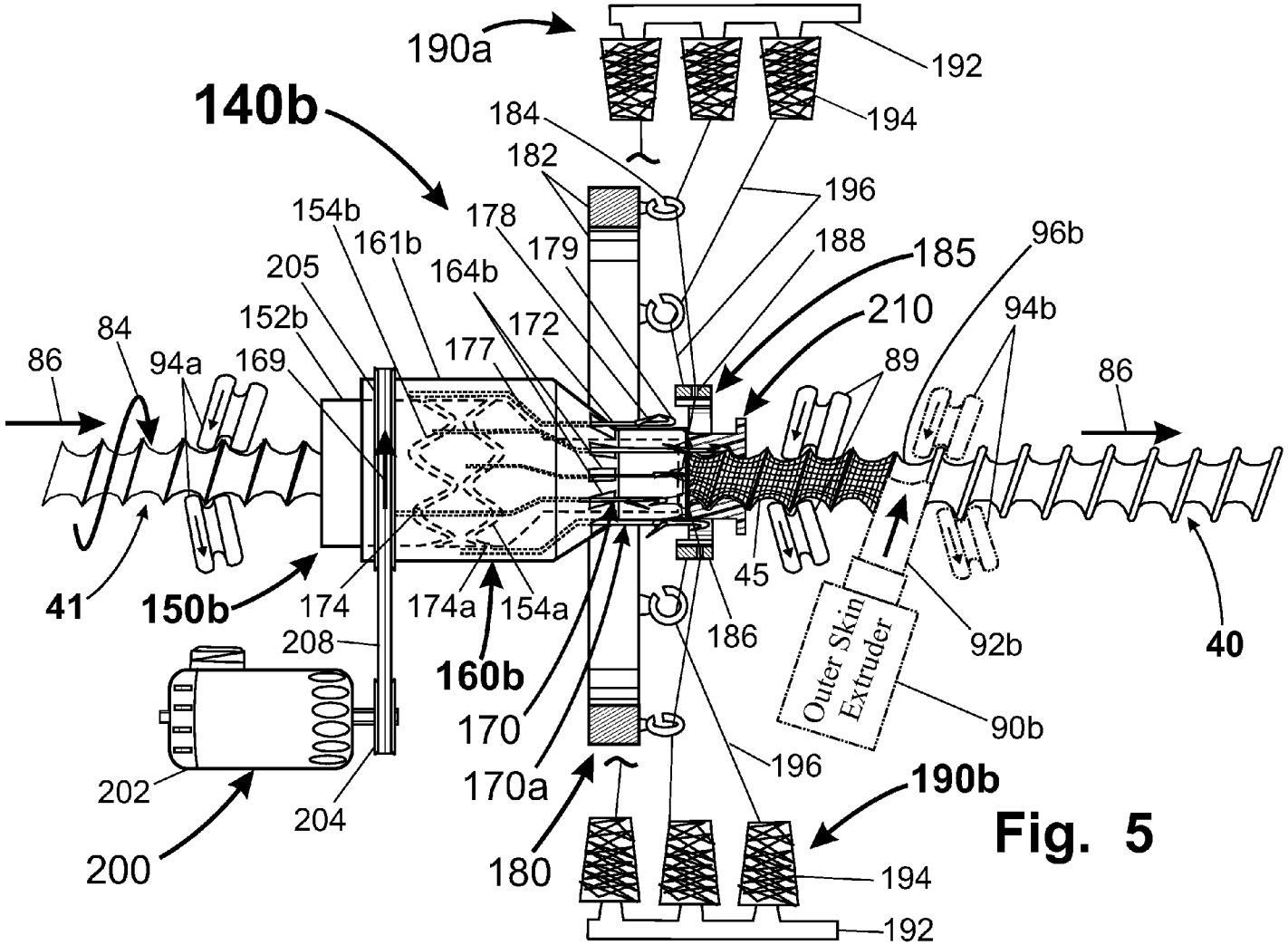

FIG. 5 Complete circular weft knitting machine, including stabilizing rollers, belt driven knitting head, yarn guide assembly, and yarn support racks. Knitting machine 140*b* can be used on the example production stretch hose line in FIG. 2.

Figure 6:
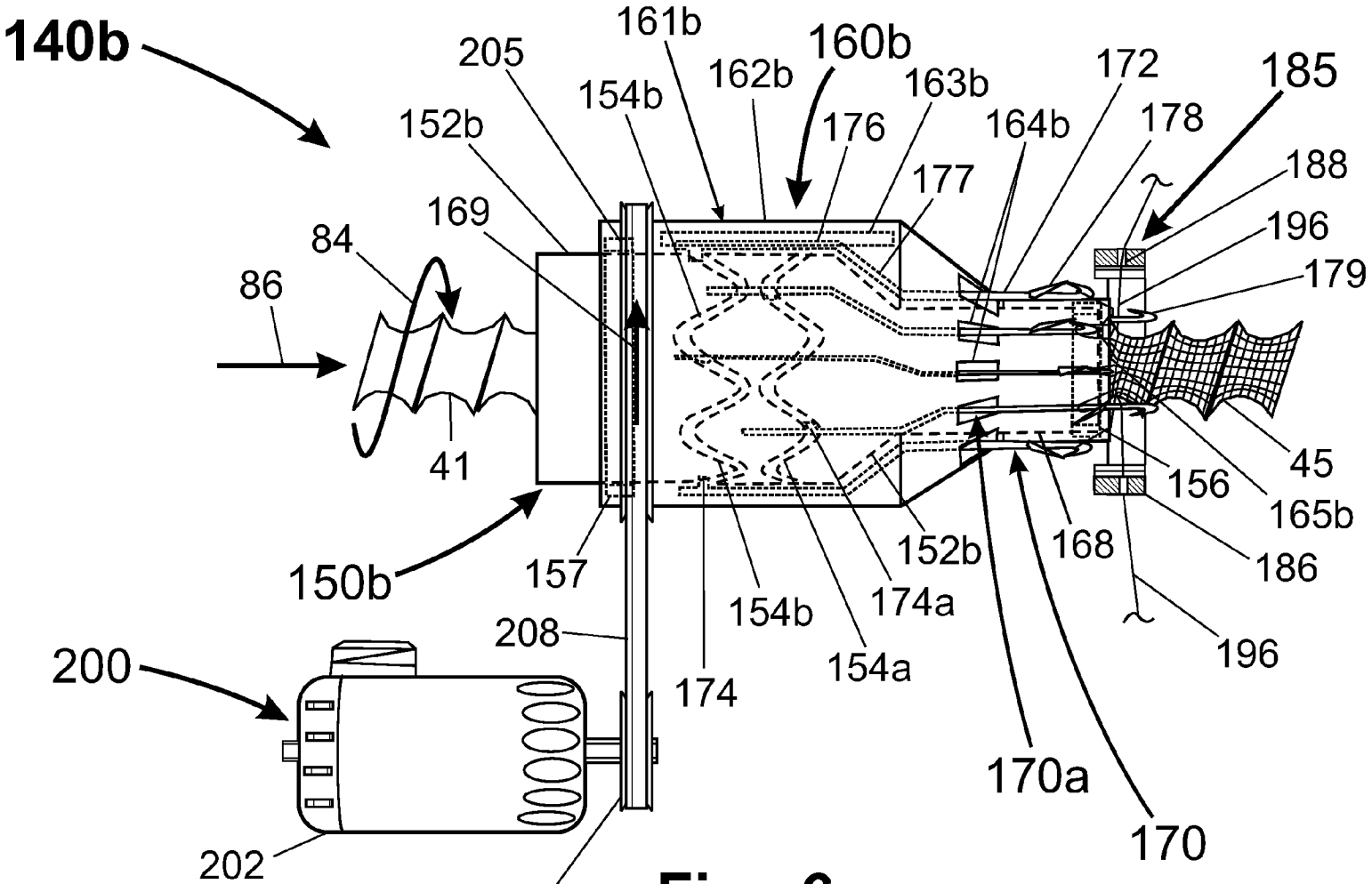

FIG. 6 Enlarged side view of knitting head 160*b* seen in FIG. 5 with hold down ring 210 removed to show needle action more clearly.

Figure 7A:
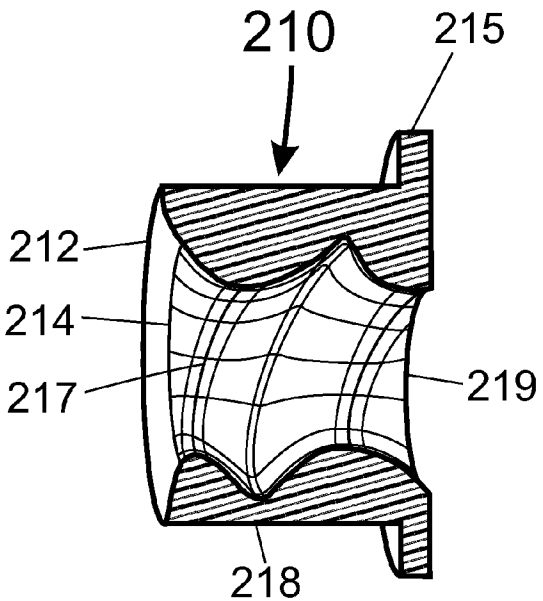
Figure 7:
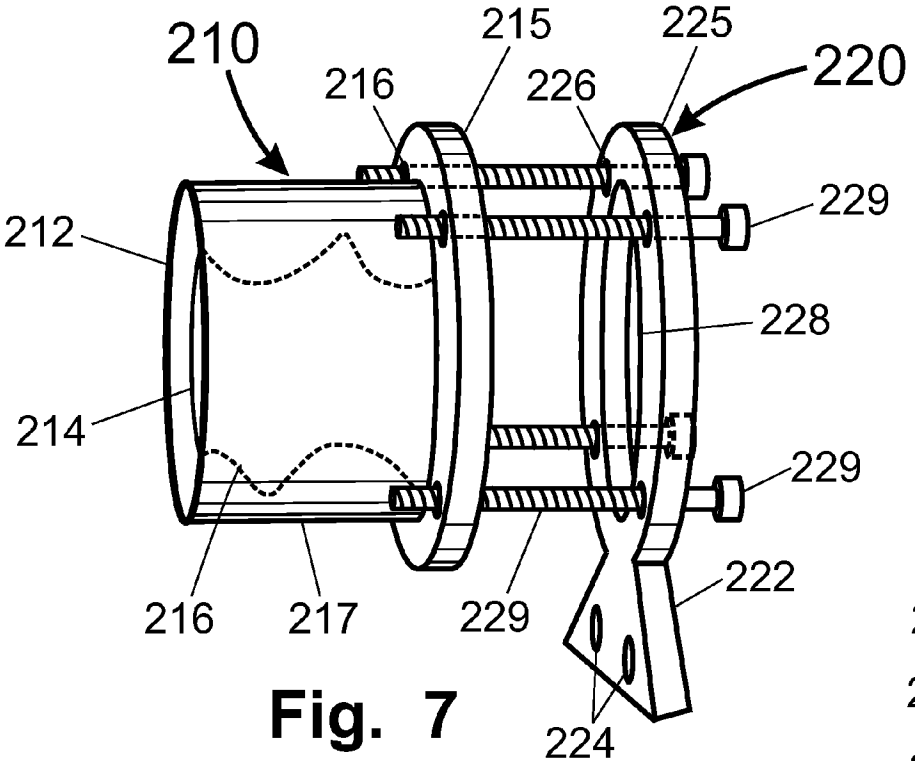

FIG. 7 Perspective view of the hold down ring assembly comprising hold down ring 210 and adjustment ring assembly 220.

FIG. 7A Perspective view of cross-sectioned hold down ring 210.

DETAILED DESCRIPTION OF THE INVENTION

The examples of circular knitting equipment disclosed here can all be manufactured using standard machining and manufacturing methods common to the knitting equipment industry. Methods that might be employed can comprise, CNC machining and grinding, lathe work, sheet metal stamping, precision machining and other metal and plastic forming processes. The preferred construction material for the knitting head and needles is stainless steel, and other steel alloys, though other materials can be used.

In FIG. 1, we see a prior art hose knitting machine 10 comprising a rotatable deck 15, a feeder head assembly 30, a knitting head 20, and support arrangement of pulleys 13. Rotatable deck 15 is rotated by motor 26 through drive shaft 27 and gear box 28. Yarn package mounts 17 are mounted on deck 15 and supports yarn packages 16 for feeding yarn 18 to feeder head assembly 30 and ultimately to knitting head 20. Rotatable deck 15 also supports frame posts 32 and support plate 34. Where support plate 34 has an annular opening centrally therethrough to permit passage of the reinforced hose 14 with yarn pattern P. Feeder head assembly 30 is mounted to, and moves with, rotatable deck 15 and comprises multiple yarn feeder units 36, one feeder unit for each of the corresponding yarn spools 16. Feeder units 36 are those characterized in the industry as "positive feeders" that incorporate yarn tensioning controls that even the tension of the yarn fed through the unit regardless of the feed rate. Feeder units 36 are well known in the industry and many styles and types exist, from the simplest tensioning eyelets 184 seen in FIG. 5 to very complex servo-motor driven systems, many in-between. for feeding yarn at a specific rate to knitting head 20, through yarn feeder units 36 supported by. Knitting head comprises a plurality of knitting needles 22 sequentially driven by a multi-lob cam ring 24. The cam ring or cam track is often attached to rotatable deck 15 so that it rotates in alignment with spools 16 and yarn feeder units 36. Knitting needles 22 can be any of a number of designs, but for cylindrical knitting machines like this, needles 22 are often latch type knitting needles.

During operation unreinforced hose 12 is pulled through knitting head 20 and circular plate 34, and through an arrangement of pulleys 13 to a remote pulling system not seen in FIG. 1. As hose 12 passes through knitting head 20 knitted pattern P is knitted onto hose 12 using a number of yarns 18. For this prior art design, the yarn spools 16, knitting head 20 and feeder head assembly 30 are all rotating around the axis of hose 12 while pattern P is being knitted.

The Applicant's disclosed Circular Weft Knitting Machine accomplishes the same reinforcement of a axially rotating hose with a much less complexity and cost circular knitting system (see FIGS. 2, 3, 4, 5 and 6). In the Applicant's design, the needles are rotated while the other supporting equipment and yarn spools do not need to rotate at high-speed. This allows for continuous high-speed operation since the Yarn Spools (Yarn Packages) and Feeder Head Assembly do not need to rotate at high-speed around the knitting head. The machining of the components needed for the disclosed Circular Weft Knitting Machine are compatible with present technology found in the knitting industry.

In FIG. 2, we see a proprietary production line drawn in limited detail to show the environment in which the disclosed Circular Weft Knitting Machines 140*a* and 140*b* can operate. This example shows seven phases for the production of a reinforced stretch hose. The process is continuous, which reduces the down time and reduces material handling.

In Phase I, a wire coiling machine 80 is used to bend a Wire 81 into a coiled tension spring and is coiled around a mandrel 42. This process is well known in the art for manufacturing single layer stretch hose 41.

In Phase II, The mandrel structure stretches the coils of the tension spring to the proper pitch as the spring rotates around the mandrel. After the spring is at the correct pitch, an Inner Skin Extruder 90*a* extrudes a polymer strip 96*a* over the rotating coiled spring. An extruder nozzle 92*a* positions and orients strip 96*a* to produce a substantially seamless stretch hose 41 (seam is very difficult to detect if manufactured correctly) after being pressed by one or more shaping/stabilizing rollers 94*a* onto rotating mandrel 42. As the extruded strip 96*a* follows the coiled wire around mandrel 42 it meets back around with itself and its two edges are fused together by one or more Shaping Rollers 94*a*. This process of making single-layer stretch hose 41 is well known. For many polymers, the heat of extrusion is sufficient to create very good bonding by rolling or pressing the seam (where the two edges of the extruded strip meet). In other processes adhesives and/or solvents can be used to produce bonding. These first two phases form a sealed convoluted stretch hose over the coiled tension spring. The polymer used for the strip depends on the desired use of the hose. For a flexible stretch hose, the extruded polymer might be an elastomer like polyurethane, pvc, or other plastic elastomers. The Front Stabilizing Rollers can be motor driven if needed.

In Phase III, the disclosed circular knitting invention knits a reinforced cover over the convoluted single-layer stretch hose 41. In FIG. 2, the knitting head rotates with the convoluted stretch hose 41 (coiled tension spring 81 and polymer inner skin 96*a*) so that knitted material layer 45 from knitting machine 140*b* can fall evenly on the convoluted shape. The rotation rate of the knitting head 160*b* (see FIGS. 5 and 6) is preferably in the same direction as the rotation of the hose, and can be made to rotate faster, slower or equal in speed to the hose depending on the type of reinforcement that is desired. Knitting Machine 140*b* can work together with the Shaping/Stabilizing Rollers (i.e. 94*a-b*, 44, 89, etc.) before and after the knitting head to keep the hose properly positioned while knitting and tightening the reinforcement layer 45 around single-layer stretch hose 41. Three Rear Stabilizing Rollers 44 (two rollers shown) on the right side of Knitting Machine 140*b* are shaped to provide the desired shape of the valley of the convoluted hose being made. These Rear Stabilizing Rollers are preferably motor driven and speed controlled (motor and speed controls are not shown) to provide the most stable motion for Knitting machine 140*b*. The mandrel inside the hose can also assist in this shaping process. Stabilizing Rollers 44 can be mounted to a fixed support (not shown) and rotate along an axis that is close to parallel to the axis of the stretch hose. Because this type of helical or convoluted stretch hose 41 has a helical structure, its coils appear fixed as it rotates along its production path. Stabilizing Rollers 44 use this fact to assist in rotating the hose while keeping the convolutions at a fixed location and the hose expanded during processing. The Drive Rollers in Phase VI provide the same stabilization of the hose for the Cutter or Hydraulic Knife in Phase VII. Thus, the ridges of the stretch hose appear to be stationary even though they are rotating rapidly around the axis of the hose. The hose rotates like this throughout the production line (Phases I through VII). Stabilizing Rollers 44 preferably comprise a set of three rollers (only two shown) to trap the stretch hose between them and have one or more roller lobes (Rear Stabilizing Rollers 44 having three lobes).

In Phase IV, a second extruder 90*b*, with a complex extruder head 92*b*, is then used to extrude an outer layer 96*b* over knitted reinforcement 45 and Inner Skin 96*a*. Preferably outer layer 96*b* is an elastomer with good strength, water resistance, and wear properties. One or more Shaping/Stabilizing Rollers 94*b* near Extruder Head 92*b* can further shape the three layers (Inner Skin 96*a*, Knitted Reinforcement 45, and Outer Skin 96*b*) into its final reinforce stretch hose structure 40. Additional shaping rollers and Stabilizing rollers can be used if needed. Outer layer 96*b*, while still in its molten state, can be forced between spaces in knitted reinforcement layer 45 and bonded to both inner layer 96*a* and reinforcement layer 45. Rollers 94*b* can compress the three layers into a monolithic hose structure.

In Phase V, the finished stretch hose 40 then continues into a water tank cooling system 46. Water can be sprayed on the hose or the hose can rotate on top of the water to quickly cool the hose to a solid state. This type of cooling is typical for thermoplastic materials where no cure time or drying is needed for the polymer to obtain its desired properties.

In Phase VI, additional Driven Stabilizing Rollers 47 are used to stabilize the hose while being cut, and to keep the hose stretched during the previous production phases. Rollers 47 also absorb vibration so that the process of cutting the hose does not send motion back up the production line which could cause processing and quality control problems. Roller 47 would likely be motor driven and speed controlled (motor and speed controls are not shown) to insure a stable processing speed, hose stretch, and hose shape.

In Phase VII, a high speed cutting tool 48 is used to cut the hose to the correct length. Because finished stretch hose 40 is rotating during the manufacturing process, there is the problem of rolling the hose up after it is made. Thus, this type of hose production process can cut the rotating hose into the proper length hoses as it is being made. It is common for industry to use two rotating cylinders (not shown) placed after driven rollers 47 and axial with hose 40 to support the rotating hose stable until it can be cut by cutter 48. Then the hose is kicked off the rotating cylinders as finished hose.

In FIG. 3, we see knitting head housing 161 removed from a knitting head assembly, and only four of its sixteen knitting needles 170 are shown to more clearly show its structure of the housing. Knitting head housing 161 and needles 170 are drawn slightly out of scale to allow the reader to more clearly see the structure of the needles. The other components, such as, the pulleys and/or gears used to provide rotary motion for knitting head housing 161 are shown in FIG. 4. Knitting head housing 161 comprises a central bore 168 for hose 41*a* to pass through, a front knitting head housing 165, and a rear knitting head housing 162. In this design, front housing 165 and rear housing 162 are machined from a single piece of metal, but can comprise their own separate component, or can be molded or machined from other strong materials. Rear knitting head housing 162 is designed for mounting a gear 207 (see FIG. 4) on its exterior for providing rotary motion to housing 161 in the direction 169. Rear knitting head housing 162 is also designed for mounting of bearings 157 and needle guides 163 on its interior. As an alternative to needle guides 163, rear housing 162 can optionally comprise a structure for excepting removable needle bars 175. These needle bars 175 would comprise a needle groove 173, which is a slot designed to support and guide rear needle stem 176 of knitting needles 170. The removable needle bars 175 can allow easy replacement when needle groove 173 becomes worn. Only one needle 170 is shown with needle bar 175 as an example.

In FIG. 3, needle guides for bars 175 and needle guides 163 are shown machined directly into the interior of rear housing 162 as one example of constructing knitting head housing 161. Front knitting head housing 165 comprises a number of needle tracks 166, and an equal number of needle track walls 167. Between needle guides 163 and needle tracks 166 is an equal number of needle windows 164. Choosing the correct number of needles and needle tracks for the knitting head depends on many factors, some of these factors are the hose diameter to be reinforced, the radial density of fibers desired for reinforcement, and others. Knitting head housing 161 is shown here with sixteen needle tracks 166 and sixteen needle guides 163 (tracks and guides on back of housing are not shown to keep drawing uncluttered). A set of sixteen needles 170 would rest in needle tracks 166 and needle guides 163 to keep the needles stable while sliding axially during the knitting process. During operation, each needle 170 produce one row of wale loops as yarn is caught by each needle to form the knit. Knitting head housing 161 is designed to produce the knits seen in FIGS. 3A through 3C in cooperation with the appropriate cam cylinder (Cam cylinders 150 and 150*b* for producing knit patterns 45*a*, 55 and 75, and cam cylinder 150*b* for producing lock stitch knit pattern 65).

In FIG. 3, four of the sixteen latch needles 170 for housing 161 are shown. Each needle 170 comprises a needle hook 179, a needle latch 178, a front needle stem 172, a middle needle stem 177, a rear needle stem 176, and a needle butt 174. The front stem 172 rests in needle tracks 166 on the exterior of housing 161, while middle stem 177 and rear stem 176 are mounted substantially inside housing 161. In alternate designs, middle stem 177 can exit housing 161 through its respective window 164. The rear stem 176 rests in an internal needle guide 163 (slot) similar to needle tracks 166, but on the inside surface of rear housing 162. In present industrial practice, these internal needle guides for supporting and guiding rear stem 176 are often machined into removable needle bars (see needle bar 173 in FIG. 4) that can be mounted onto housing 161 so the needle guides can easily be replaced when the guide slots becomes worn.

The shown cylinder knitting needles 170 are latch type knitting needles and can operate at high speed. Other styles of knitting needles and knitting heads can be use to produce various knit patterns for reinforcement of a hose. Some additional structure may be required for specific knitting heads and for specific knit patterns that are common to the industry. For example, Bearded needles, compound needles and open stem slide needles could be used with the proper knitting head. Middle needle stem 177 provides an offset between front needle stem 172 and rear needle stem 176. This offset allows for a large diameter cam track cylinder 150 and 150*b* (see FIGS. 4-6), while the actual ring of knitting hooks 179 can be much smaller in diameter (see FIGS. 3-6). This smaller diameter for the knitting needle hooks 179 allows for knitting reinforcement on small hose diameters than would generally be possible with a straight cylinder needle. With a larger diameter cam track the needle butt 174 can make contact with a more slowly rising and falling cam track (shallower track angle) which reduces friction and allows faster operation.

In FIG. 3, knitting head housing 161 has produced a reinforcement hose 40*a* by covering hose 41*a* with knitted reinforcement cover 45*a*. In this example, knitting reinforcement 45*a* is pulled inside knitting head housing 161 as hose 41*a* moves from left to right and rotates in a left-handed direction (note that the yarns being knitted are not shown in FIG. 3 at the needles to keep that area readable). This motion of the hose through housing 161 turns the "technical back" of reinforcement 45*a* to face outward on the exterior of the hose. In other situations, it is desirable to have the "technical face" of reinforcement 45*a* facing outward. To accomplish this, housing 161 can be turned around to face in the opposite direction (see FIGS. 5 and 6) or hose 41*a* can be moving from right to left with housing 161 facing the same direction. Rotation direction for both housing 161 and hose 41*a* can remain the same.

In FIGS. 3A through 3C, we see three example knit patterns that can be produced by knitting head housing 161 and needles 179. All three examples are shown with "technical back" showing (surface facing outward from hose), which means the ribbing pattern produced by plain stitch knits would be showing. If the knit reinforcement were pulled in the opposite direction shown, the knit would appear very similar, but the "technical front" of the knit would face away from the hose, as seen in FIGS. 5 and 6. In FIGS. 3A and 3C, we see plain stitch reinforced hoses 50 and 70, respectfully, which can be produced by using housing 161 with stationary cam assembly 150 (see FIG. 4). With cam assembly 150 has a single cam track 154, and when combined with housing 161 can produce a plain stitch knit can be produced with each knitted loop produced by one knitting needle 170. In FIG. 3B, we see a lock stitch reinforced hose 60, which can be produced using the same knitting head housing 161, but combined with a double track cam system like cam assembly 150*b* seen in FIGS. 5 and 6, two sets of knitting needles (i.e. 170 and 170*a*).

In FIG. 3A, we see reinforced hose 50 with plain stitch knitted reinforcement 55 on hose 41*a*. The loops or wales in this example are being knitted in direction 57, and the courses are being knitted in direction 58. In this example, knitting head housing 161 would rotate slight faster than rotation rate of hose 41*a* (spiral motion 83) so that the loops knitted would tend to angle in the direction of rotation of the knitting head. The loops created would be slightly shorter and courses slightly narrower than the same knit pattern if hose 41*a* and housing 161 rotating at the same rate (see knit pattern 45*a* in FIG. 3).

In FIG. 3B, we see reinforced hose 60 with lock stitch knitted reinforcement 65 on hose 41*a*. The loops or wales in this example are being knitted in direction 67, and the courses are being knitted in direction 68. In this example, knitting head housing 161 is rotating at approximately the same speed as the rotation rate of hose 41*a* (spiral motion 83) during the reinforcement process. This equal rotation speed relationship, results in the knitted loops tending to align parallel to the hose's longitudinal axis. The length of the loops created and width of the courses would be determined by the combination of the rotation rate 83 and 169 of hose 41*a* and housing 161, respectfully, and the pull speed 82 of hose 41*a* through housing 161. The faster the hose pull rate 82, the longer the loops and the wider the courses for the same rotation rate. Similarly, the faster the rotation rate 83 and 169, the shorter the loops and narrower the courses for the same pull rate.

In FIG. 3B, lock stitch 65 is a standard reinforcement stitch used in the industry for hose reinforcement. The lock stitch allows the yarn to float over one or more knitting needles during the knitting process. In this example, every other needle engages the yarn so that the yarn floats over every other needle. Thus, for a sixteen needle head seen in FIG. 3, the needles behave like two sets of eight needles, each set having either the odd numbered needles around the knitting head or the even numbered needles. Each set of odd or even needles produce half of the lock stitch pattern. If we use six feed yarns in this example, then each set of eight needles would produce half of the six courses, or three courses. Looking at FIG. 3B, we see odd numbered yarn loops 61 (shown in dark lines) knitted by the odd numbered needles, and even numbered yarn loops 62 (shown in light lines) knitted by the even number needles. Notice that both yarn loops 61 and 62 come back around every three courses of its odd or even numbered yarns, or comes back around every six total courses of knit 65. The way lock stitches are done the odd numbered stitches interlock with the even number stitches, and visa versa, so the two cannot be separated. Loops are generally formed on top of the float sections in this technical back orientation. Loops are generally formed under the float sections (skipped needle section) when the technical front of the knitted reinforcement is placed on the exterior (see FIGS. 5 and 6 for examples of knitting machine setup to produce technical front face knits on exterior of hose).

In FIG. 3C, we see a reinforced hose 70 with a plain stitch knit reinforcement 75 on hose 41*a*. The loops or wales in this example knit are being knitted in direction 77, and the courses are being knitted in direction 78. In this example, knitting head housing 161 would rotate slightly slower than rotation rate of hose 41*a* (spiral motion 83) during manufacturing. This results in the knitted loops to angle in the opposite direction as the rotation of the knitting head. The loops created in reinforcement knit 75 are slightly longer and courses slightly wider than if housing 161 and hose 41*a* rotated at the same rate (see knitted pattern 45*a* in FIG. 3), because the slower rotation of the knitting head provides a slower knitting process and hose 41*a* can move further during each knit.

In FIG. 4, we see knitting head assembly 160 which is part of knitting machine 140*a* for producing reinforced hose 100. Knitting machine 140*a* is shown without its yarn tensioning and guiding systems, but can comprise a similar collection of components as seen in FIG. 5, which can comprise yarn guide assembly 180, timing ring 185, hold down ring assembly 210 and 220, and yarn spool racks 190*a-b* (see FIG. 5). Many yarn feeding and control systems are used by the knitting industry and the technology is well known. The example of the yarn tensioning and guiding system seen in FIG. 5 is just one example of many possible configurations.

In FIG. 4, knitting head assembly 160 comprises a knitting head housing 161, a plurality of knitting needles 170, a stationary cam assembly 150, and a motor 202 with pinion 206 to drive knitting head housing 160 in a rotary motion in direction 169. Knitting head housing 161 can comprise a single piece of stainless steel if desired with a front housing portion 165, a rear housing portion 162, and a plurality of needle windows 164 between the front and rear portions of housing 161. Rear housing portion 162 supports a gear 207 mounted to its exterior and designed to be driven by a pinion 206. As is common in the industry the interior of rear housing portion 162 can be machined to comprise interior guides 163 to help support and guide rear needle stems 176. Gear 207 is positioned so that pinion 206 provides rotary motion from motor 202 and turn knitting housing 161 and knitting needles 170 at a predetermined speed.

In FIG. 4, front housing portion 165 of housing 161 can comprises a central bore 168 for hose 101 to pass through, a plurality of needle tracks or guides 166, as seen in FIG. 3, and an equal number of needle track walls 167. The front needle stems 172 of each needle is positioned within its respective needle track 166 and are guided by the needle track walls 167 as shown in FIG. 3 to keep needles 170 stable during high-speed operation. Similarly, rear needle stem 176 of each needle is positioned within its respective needle guide 163 (see FIGS. 3 and 4).

In FIG. 4, stationary cam assembly 150 can comprise a cam cylinder 152 and a plurality of bearings and/or bushings 156 and 157 to rotatably connect knitting housing 161 to cam cylinder 152. The plurality of bearings 156 and 157 can be placed between cam cylinder 152 and knitting head housing 161 to provide mechanical support for housing 161 and allow it to rotate around cam cylinder 152 at high-speed. The style of bearings can be chosen from the many existing bearing designs that can provide stable rotation of housing 161 around cam cylinder 152.

In FIG. 4, cam cylinder 152 can comprise a single piece of metal with one or more cam tracks 154 machined into its outer surface. Alternately, cam track 154 can comprised of a plurality of removable timing cam segments that are mounted on the exterior of cam cylinder 152. Such removable timing cam segments are common in the knitting industry. This allows the cam timing to be easily change by switching out the multiple timing cam segments as needed for different knit patterns. Cam track 154, in this example, is machined into cam cylinder 152 and follows a wavy path around the cam cylinder as shown. Needle butt 174 on knitting needles 170 engage track 154 to provide the coordinated axial motion of needles 170 and provide the desired knitting action when house 161 is rotated with respect to cam cylinder 152. The exterior surface of cam cylinder 152 can be used to keep needles 170 engaged within the interior needle guides 163 (slots) on the interior of rear knitting housing 162. Thus, as housing 161 rotates around cam cylinder 152, needle butts 174 follow cam track 154 which pushes needles 170 in and out along needle tracks 166 (see FIG. 3) and guides 163 to provide the knitting action. The shape of cam track 154 provides the proper timing for the movement of needles 170 to provide the knitting action. The proper placement of knitting yarns 196 as it enters needles 170 and engages needle hook 179 is needed so that the needle motion, created by cam track 154, matches the yarn timing (timing is discussed further in FIGS. 5 and 6). This type of cam action of knitting needles 170 is common in the knitting industry and many other options exist for actuating the needles. Knit reinforcement 104 on hose 100 has been pulled back through knitting head 160, which means that the "technical back" of the plain knit is facing outward. In FIGS. 5 and 6 we will see knitting head 160*b* that provides a plain weft knit reinforcement with the "technical face" oriented outward. Both "technical back" and "technical face" knits can be made with the same knitting head.

In FIG. 5, we see the preferred embodiment of the disclosed circular weft knitting machine 140*b* producing a knit reinforced hose 40 comprising a wire reinforced stretch hose 41, a knitted reinforcement 45, and an outer skin 96*b*. Extruder 90*b* and extruder nozzle 92*b* and forming rollers 94*b* are shown here as a manufacturing process for covering reinforcement 45 on rotating stretch hose 41. Both knitting machines 140*a-b* can be used to provide this type of reinforcement. Extruder 90*b* extrudes a polymer strip through nozzle 92*b* to form outer skin 96*b*. Rollers 94*b* and mandrels 42 (see FIG. 2) are designed to press inner hose 41, reinforcement 45, and outer skin 96*b* together into a durable bonded stretch hose. Shaping/Stabilizing rollers 94*a-b* and 89 are shown here as one means of stabilizing and shaping a rotating convoluted hose. Standard industry practices generally use an exterior mandrel tube inside the knitting head housing 161*b* and/or cam cylinder 152*b*, to stabilize the hose as it goes through the knitting portion of knitting head 161*b*. It is important that hose section 41 has a stable position while going through knitting machine 140*b* so that a consistent knitted reinforcement 45 can be produced on the exterior of hose 41. Because this knitting machine will reinforce a convoluted hose, stabilizing the hose in the axial direction is also important. This stabilizing function or stabilizing means can be provided by many different types of systems, such as, by internal mandrel 42 which interacts directly with the support wire inside hose 41, stabilizing/tensioning rollers 43, and/or stabilizing rollers 44 (see FIG. 2). Rollers 43 and 44 would generally come in sets of three or more (only two shown) to trap hose 41 between them. The contact surface of mandrel 42, rollers 94*a-b*, 89 and rollers 44 (see FIG. 2) can be actively driven to motivate hose 41 to follow a spiral motion 84. Both mandrel 42 and rollers 44 can be used to stabilize hose 41 in all directions: horizontal, vertical and axial. Stabilizing the transverse position of the hose (vertically and horizontally) within knitting machine 140*b* is important so the hose is centered within the knit head to provide even coverage of yarn. However, a cross-section of convoluted hose 41 is not centered with respect to the exterior ridge of hose 41. Thus, stabilizing the axial position of convoluted hoses similar to hose 41, is important because the transverse position of the cross-section of a convoluted hose will change as one move along its axis. Thus, the ridges of hose 41 can be properly located with respect to knitting head 160*b* if horizontal, vertical and axial motion of the hose's position are all stabilized. Similarly, knitting machine 140*a* can require axial stabilization if it were to knit reinforcement on a convoluted hose similar to hose 41. Note that hose 41, when stabilized by mandrel 42 and/or rollers 94*a-b* and 89, can still move along the spiral motion 84, and maintaining its ridge structure in a fixed location in space. Thus, even though hose 41 is spiraling from left to right in FIG. 5, the location of the spiral ridge of hose 41 can appear to be in the same location as seen in FIG. 5 at all times. Hose 41 can be manufactured on a rotating production system just prior to entering knitting machine 140*b* (similar to production line seen in FIG. 2), or be made separately and rotated into knitting machine 140*b* by a rotating means so as to have spiral motion 84.

In FIGS. 5 and 6, Circular weft knitting machine 140*b*, is shown as one example of the disclosed invention which is designed to knit reinforcement on an axially rotating hose. Knitting machine 140*b* can conform its knit reinforcement 45 to nearly any hose structure and shape since knitting machine 140*b* can tightens knit reinforcement 45 around the hose as it is being knitted. Many knit patterns can be used, including, but not limited to, the plain stitch and lock stitch patterns that can conform to odd shapes like a convoluted hose. Some care is needed to properly tighten the yarn knit reinforcement around the hose in order to provide even coverage and to provide the correct tightness of reinforcement 45 around the hose.

In FIGS. 5 and 6, we see circular weft knitting machine 140*b*, comprising shaping/stabilizing rollers 94*a-b* and 89, knitting head 160*b*, yarn guide assembly 180, yarn timing ring 185, yarn spool racks 190*a* and 190*b*, drive system 200, and a hold down ring assembly comprising hold down ring 210 and adjustment ring assembly 220. As stated previously, the stabilizing means provided by rollers 94*a-b* and 89 can alternatively be provided by any of a number of other stabilizing means that sufficiently stabilize the hose's position to allow knitting machine 140*b* to properly reinforce hose 41. Methods of stabilizing can include those that stabilize the hose horizontally, vertically and axially, including, but not limited to, a central mandrel within the hose (see FIG. 2), and other roller and guide systems for the hose (see FIG. 2).

In FIGS. 5 and 6, knitting head 160*b* can comprises knitting head housing 161*b*, cylinder cam assembly 150*b*, and a plurality of knitting needles 170 and 170*a*. Knitting head housing 161*b* forms the exterior of knitting head 160*b* and comprises a front portion 165*b* with a central channel 168, a rear portion 162*b*, a plurality of needle windows 164*b* between these two portions. Central channel 168 is the same as that seen in FIG. 3, and can extend through the entire knitting head 160*b*. Needle windows 164*b* allow needles 170 and 170*a* to pass between the interior of rear portion 162*b* and the exterior of front portion 165*b*. Rear portion 162*b* comprises a pulley 205 mounted securely to it, and a plurality of internal needle guides 163*b* (shown in FIG. 6) for guiding rear needle stems 176. Front portion 165*b* comprises structures similar to needle tracks 166, and needle walls 167 seen in FIG. 3, but not shown in FIGS. 5 and 6 to keep the drawing readable. Cam cylinder assembly 150*b* comprises cam cylinder 152*b* and bearings 156 and 157. Cam cylinder 152*b* comprises two cam guides 154*a* and 154*b* which can be machined into cam cylinder 152*b* or alternatively comprise removable cam plates or segments that are mounted to cam cylinder 152*b*. Front bearing 157 and rear bearing 156 are mount between housing 161*b* and cam cylinder 152*b* to allow rotatable motion of housing 161*b*. Front bearing 157 supports the front portion 165*b* of knitting head 161*b* and rear bearings 156 supports the rear portion 162*b* of knitting head 161*b*. Bearings 156 and 157 can provided both radial and thrust bearing support (also see bearing use in knitting head 160 in FIG. 4). Knitting needles 170 have already been discussed in reference to FIG. 3, and knitting needles 170*a* have similar construction components, but has a shorter length so that it can used with a front cam track 154*a* instead of rear cam track 154*b*. Knitting needles 170 have a needle butt 174 that interacts with rear cam track 154*b*, and knitting needles 170*a* have a needle butt 174*a* that interacts with front cam track 154*a* to provide knitting motion. Generally, equal numbers of needles 170 and needles 170*a* are used. Note, the shape of cam tracks 154*a-b* is only one example of possible cam timing and cam shapes that could be used. The difference in length of needles 170 and 170*a* allow the needle hooks 179 of both needles to be aligned properly at front portion 165*b* even though they use different cam tracks.

In FIG. 5, yarn guide assembly 180 is shown providing a feeding and tensioning means for circular knitting machine 140*b*, and can alternatively comprise a feeding and tensioning means for circular knitting machines 140*a*. Yarn guide assembly 180, seen in FIG. 5, comprises a yarn guide housing 182, and yarn tensioning eyelet 184. Yarn guide assembly 180 is shown in its most simple form, and generally would comprise standard tensioning and guiding components that have been common in the knitting industry for decades. Yarn guide assembly 180 can also include active yarn feeding systems if needed (see FIG. 1). Yarn guide housing 182 comprises a support ring for positioning and tensioning eyelets 184 attached radially around knitting head 160*b*. Eyelets 184 are positioned to feed yarn to yarn guides 188 on timing ring 186. Eyelets 184 can also be designed to provide yarns 196 to knitting needles 170 and 170*a* with nearly equal tension.

Tensioning eyelets 184 are a common way of tensioning yarn in the knitting industry, but generally several eyelets are used with each yarn thread 196. Eyelets 184 can comprises several ceramic eyelets mounted on a support plate to provide adjustable tensioning by threading the yarn through the appropriate number of eyelets to provide the desired tension. The larger the number of eyelets the yarn passes through, the greater the tension in the yarn reaching knitting head 160*b* and knitting needles 170 and 170*a*. Other methods of tensioning yarn 196 can include, but not limited to, passing the yarn between two plates that are spring loaded, and using active feeding rollers to more precisely control tension and/or yarn feed rates. There are also many other industry standard tensioning systems. For example, feeder units 36 seen in FIG. 1, is another example of a feeding and tensioning means. Feeder units 36 are similar to feeder units common to the knitting industry and can replace eyelets 184 as a yarn tensioning means. Complex feeder units with actively controlled servo-motors can also be used with the disclosed circular weft knitting machines. Because the feeding and/or tensioning means on the disclosed invention does not need to move, a more complex and larger feeding and/or tensioning means can be used as a substitute for eyelets 184 in the disclosed circular knitting machines. In fact, nearly any industrial tensioning and/or feeder system for knitting machines can be adjusted for use with the disclosed invention to provide proper tensioning with only minor modification.

In FIGS. 5 and 6, drive system 200 comprises a motor 202, a pair of pulleys 204 and 205 and a drive belt 208. Motor 202 can be nearly any electric motors and does not matter whether it is one-phase or three-phase, as long as, the needed horsepower is provided. Motor 202 can be speed controlled to allow it to match rotational speeds with hose 41 and/or a fraction of the hose's rotation speed (see spiral motion 84). Pulleys 204 and 205 are connected to motor 202 and knitting head housing 161*b*, respectfully and designed to engage pulley belt 208. Pulley belt 208 can preferably be a toothed timing belt to prevent slippage. A toothed timing belt would require pulleys 204 and 205 to have matching tooth slots for proper operation with belt 208. Belt 208 is designed to transfer rotary motion from pulley 204 to pulley 205, which allows transfer of rotary motion from motor 202 to knitting head housing 161*b*.

In FIGS. 5 and 6, yarn timing ring assembly 185 is shown comprising a timing ring 186 having a plurality of yarn guides 188. Additional adjustment structure (not shown) is normally included with industry standard timing ring assemblies to allow precise positioning of timing ring 186 with respect to knitting needles 170 and 170*a*. These additional adjustment structures normally involve a number of adjustment screws for positioning and rotating timing ring 186 to its proper position and orientation. Yarn guides 188 are commonly made of ceramic rings to reduce friction and wear and allow yarns 196 to slide freely without catching. When properly positioned, timing ring 186 directs yarns 196 into hooks 179 on the proper needles 170 and 170 as they rotate pass.

In FIG. 5, yarn spool racks 190*a* and 190*b* comprise a support rack 192 and a plurality of yarn spools 194. Support rack 192 can hold spools 194 in a number of methods that are common to the knitting industry. Racks 190*a-b* are designed to allow yarn 196 from spools 194 to feed off easily to yarn guide assembly 180 and can include additional guide structure (not shown) to get yarn 196 from spools 194 to tensioning guide eyelets 184.

In FIGS. 5, 7 and 7A, we can see a convoluted shaped hold down ring 210 comprising a front edge 212, a knit shaping entrance 214, a support plate 215, a plurality of threaded adjustment holes, an interior convoluted surface 216, an exterior needle guide surface 217 and knit shaping exit 219. Front edge 212 has a smooth circular shape for contact with knitted fabric coming off knitting head 160*b* and is designed to keep the knitted fabric tight against the front edge of front portion 165*b* of knitting head housing 161*b* by providing a small gap for knitted fabric 45 to slide through. Outer surface 217 is sized to be slightly smaller in diameter than the inside ring of knitting needles 170 and 170*a* to provide mechanical support of the needles during operation. Knit shaping entrance 214 guides the knitted fabric reinforcement 45 into the interior of hold down ring 210 where it is shaped to the desired shape by convoluted interior surface 216. The shape of surface 216 can be modified depending on the type and use of the hose being produced. After the knitted reinforcement 45 exits through knit shaping exit 219, tension within knit 212 holds the knit in the convoluted shape long enough for an outer layer 96*b* to be applied and lock yarn knit 45 into the convoluted shape. Knit shaping entrance 214 in this example is centered with respect to knitting needles 170 and 170*a*, and cylindrical surface 217, so that the initial contact point of knit reinforcement 45 on hose 41 is centered with respect to the knitting needles and/or front edge 212. This allows for even tensioning of knitted reinforcement 45 onto hose 41, but also means that convoluted surface 216, as a whole, is not centered within hold down ring 210.

Hold down ring 210 can be machined from a single piece of steel so that support plate 215 is part of ring 210. Alternatively, support plate 215 can be welded onto the remainder of ring 210 or bolted in place. Threaded holes 216 are machined into support plate 215 to allow adjustment screws 229 to adjust its position. Lateral (horizontal and vertical) adjustment structure (not shown) can also be added if needed. Some lateral positioning can be obtained with oversized holes 224 on adjustment ring assembly 220.

In FIG. 6, we see an enlarged view of circular weft knitting machine 140*b* seen in FIG. 5. Yarn guide assembly 180, yarn spool racks 190*a-b*, and hold down ring assembly formed by hold down ring 210 and adjustment ring assembly 220 have been removed from the drawing to more clearly show the knitting needles 170 and 170*a* operation.

In FIGS. 7 and 7A, we see the hold down ring assembly comprising hold down ring 210 and adjustment ring assembly 220. The structure of convoluted shaped hold down ring 210 has been discussed above and is designed be adjustable through threaded screws 229 that are rotatably connected to adjustment ring 225. Rotating screws 219 move the position of plate 215 by turning withing threaded holes 216. Adjustment ring assembly 220 comprises a support bracket 222, a plurality of mounting holes 224, an adjustment ring 225 with a central hole 228, and a plurality of adjustment guide holes 226 for rotatably connecting screws 229 to adjustment ring 225. Screws 229 can turn in holes 226 but are not threaded there and do not move in and out of guide holes 226. Note that many different methods of adjusting the position of hold down ring 210 exist in industry and the structure shown here is only one example.

OPERATIONAL DESCRIPTION—FIGS. 2, 3, 4, 5, 6, 7

In FIG. 2, we see a complete production line using the disclose circular weft knitting machine 140*b*, which is similar to knitting machine embodiment 140*a* (see FIGS. 3 and 4). During operation the wire coiling machine would bend the wire into a spring coil around mandrel 42. After stretching the spring coil to the proper coil pitch the inner skin extruder 90*a* covers the spring coil and seals it with rollers 94*a*, creating a water tight seal between edges of extruded strip 96*a*. This single layered hose 41 with spring wire reinforcement goes into circular weft knitting machine 140*b* where a knitted cover 45 is knitted around hose 41 to provide reinforcement to withstand higher internal pressures. Stabilizing rollers 44 are used to assist in maintaining the hose's position. Mandrel 42 can provide a very stable structure for the hose to rotate around, as can rollers 94*a-b*, 44 and 89. Stabilizing rollers 44 and 94*b* can be used to stabilize the end of mandrel 42 through interact through that portion of the reinforced hose. Generally three or more rollers 44 are needed to trap the hose and mandrel 42 within it. Outer skin extruder 90*b* then extrudes a elastomer coating 96*b* over the knitted reinforcement 45 to seal the reinforcement between inner skin 96*a* and outer skin 96*b*. After cooling through water cooling system 46, a cutter 48 is used to cut the rotating hose into proper length hoses. Drive rollers 47 can be used between the water cooling system and the cutter to keep the stretch hose stretched out so that it does not retract and bond adjacent coils together while it is still hot. The hose does not need to be fully extended the entire time it is cooling as shown. The disclosed circular weft knitting machine 140*b* can be used in any hose manufacturing line where the hose needing reinforcement is made by an axial rotating manufacturing method. A stretch hose 41, as shown, is one example of a rotating manufactured hose.

Knitting machine design 140*a* can also be incorporated in production lines similar to the production line seen in FIG. 2. Other rotational hose production process can also use with the disclosed circular knitting machines 140*a* and 140*b* and other variations not outlined in these Specifications. Knitting machines 140*a* and 140*b* disclosed in this patent, should only be considered examples of the many possible configurations for the disclosed invention.

In FIG. 3, knitting head housing 161 is shown separated from the rest of knitting machine 140*a*. Hose 41*a* enters from the left with a spiral motion 83 and passes through knitting head housing 161. Spiral motion 83 is necessary for knitting reinforcement cover to be knitted by rotating knitting head housing 161. This spiral motion 83 can be thought of as the result of the combination of the hose rotating around its axis and the hose's longitudinal travel rate 82 from left to right. Housing 161 rotates in the same direction as hose 41*a* and can have the same rotational speed as hose 41*a*. A combination of rotation rate and axial travel speed of hose 41*a* determines the angle and length, respectfully, of loops formed in the course directions 57, 67 and 77. If the rotation rate 169 of housing 161 is the same as the rotation rate of spiral 83 of hose 41*a*, then knitting needles 170 on housing 161 will move in unison with hose 41*a* and lay down longitudinal courses that are substantially aligned with the hose's axis (see reinforcements 45*a* and 65 in FIGS. 3 and 3B, respectfully). If housing 161 is rotated faster than hose 41*a*, then the knitted loops in direction 57 will wrap around hose 41*a* with a right-handed spiral like that seen in FIG. 3A. If housing 161 is rotated slower than hose 41*a*, then the knitted loops in direction 77 will wrap on with a left-handed spiral like that seen in FIG. 3C. If hose 41*a* is fed with the same spiral rate 83 for both FIG. 3A and 3C then loops formed in directions 57 and 77, respectfully, will have slightly different lengths as shown, because the rotation rate of housing 161 also determines how fast knitting needles 170 knit reinforcement. Thus, because housing is knitting slower in the example in FIG. 3C, the loops formed are slightly longer than those formed in FIG. 3A because the hose has more time to move than in FIG. 3B. If hose 41*a* is pulled or pushed through housing 161 at a faster rate (faster than motion 82) the loops formed in directions 57, 67, and 77 will get longer. Similarly, if hose 41*a* is pulled or pushed through housing 161 more slowly, the loops formed will be shorter in the directions 57, 67 and 77.

In FIG. 4, we see knitting head assembly 160 performing the operations of receiving hose 101 from the left, knitting a reinforcement cover 104 onto hose 101 and allowing finished reinforced hose 100 to exit the knitting head assembly on the right. For proper operation, hose 101 and knitting head housing 161 must be rotating in the same direction. A mismatch in speed between hose 101 and knitting head 161 will result in the knitted material having its wale loops angled away from parallel with the hose's axis and spiral around the hose (see FIGS. 3A and C). Hose 101 has a spiral motion 83 as it enters knitting head 140*a*, that is, a point on the exterior of hose 101 would follow path 83 so that it also is rotating about its axis in the direction of 169 and also translating to the right at a speed shown by arrow 82. During production, hose 101 and knitting head housing 161 rotate as shown by motion 83 and 169. Cam assembly 150 is stationary so that as housing 161 rotates needles 170, needle butts 174 on each needle engages stationary cam track 154 on cam assembly 150. Needle butts 174 follow cam track 154 causing needles 170 to slide along axially oriented needle guides 163. When a needle butt 174 in track 154 moves toward the right, that needle and its hook 179 move toward windows 164. As needle butt 174 in track 154 moves to the right, that needle 170 and hook 179 move out away from front portion 165 of housing 161. The number of needles and cam track 154 are only for example and is not drawn to show structure to produce any particular knitting pattern, just the needle action produced by that structure. Rotary motion of the hose can come from a hose manufacturing process that uses wrapping production methods, or from a hose feed system that rotates and translates the hose as shown in FIG. 4 (see spiral motion 83). Motor 202 drives pinion 206 which drives gear 207 which causes housing 161 to rotate as shown by direction arrow 169.

In FIGS. 4, we see the knitting action of needles 170 can be the common plain stitch. Other styles are possible by simply modifying the cam track(s), the needles or other parameters to achieve the desired knit pattern. Because these knit patterns are well known we will only briefly describe the plain stitch operation needles 170. Looking at FIG. 4, the needle marked 170 will move forward on knitting head 160 (to the left) as housing 161 rotates, butt 174 of needle 170 moves upward along cam 154. The shape of cam 154 is angled to push needle butt 174 of needle 170 forward along its needle track (to the left). This motion causes latch 178 is opened as the previous yarn strand 196*a* slides back against latch 178 and over it onto front needle stem 172. As needle 170 reaches its furthest forward position (most left), yarn 196*b* is positioned to fall into the portion of needle 170 between latch 172 and hook 179. After reaching its furthest left position, needle 170 is pulled back to the right, and yarn 196*b* slides into hook 179 and the previous yarn strand 196*a* pushes latch 178 closed and yarn 196*b* is pulled under previous yarn strand 196*a*. After needle 170 reaches the fully back position (most right) cam track 154 begins to again push needle 170 forward. Yarn 196*b* now becomes the next previous yarn strand and slides over latch 178 and the process repeats to form a chain of loops, one loop through the other. Note that since cam assembly 150 is stationary, needles 170 extend and retract along their tracks as they follow track 154. Thus, the position where needles are extended and where they are retracted are always the same for this disclosed system. Because of this, we will see in FIG. 5 that this allows for a stationary timing ring and stationary yarn spool racks to feed yarn 196 to needles 170 and 170*a*.

In FIGS. 5 and 6, we see knitting machine 140*b* including an example of yarn handling components 180, 185, 210 and 190*a-b*. Operation of knitting machine 140*b* is very similar to that of knitting machine 140*a* with a few modifications. One modification is the use of drive belt 208 instead of gears to drive knitting head housing 161*b*. Belt 208 can be toothed to provide a quiet and non-slip motion transfer from motor 202 to housing 161*b*. Motor 202 can be speed controlled housing 161*b* to closely match speeds with the rotation rate of hose 41, or provide a particular speed ratio between housing 161*b* and hose 41. Housing 161*b* and knitting needles 170 move together around cam assembly 150*b*, supported by bearings 156 and 157 (see FIG. 6). As housing 161*b* turns around cam assembly 150*b*, butts 174 and 174*a* of needles 170 and 170*a*, respectfully, communicate with cam tracks 154 and 154*a*, respectfully, to provide the desired knitting action with the needles.

In FIGS. 5 and 6, the timing of the motion of knitting needles 170 and 170*a* are controlled by cam tracks 154 and 154*a*. Timing ring assembly 185 is designed to present yarn 196 to the needles at the proper location to provide knitting action. Generally, timing ring assembly 185 is adjustable to allow easy adjustment to timing ring 186 to provide proper placement of yarn 196. Yarn guides 188 are positioned around timing ring 186 to match the extended positions of needles 170 and 170*a* created by cams 154 and 154*a*, respectfully.

In FIGS. 5 and 7, knitting head 160*b* is designed to knit the technical face outward, giving a smoother appearance to the knitted reinforcement. To insure a snug fitting reinforcement when knitting in this direction, hold down ring 210 is used to keep the knit reinforcement 45 tight on the knitting needles. Hold down ring is shaped in such a way to allow the knitted reinforcement to slide easily into place around hose 41. The proper placement of hold down ring 210 is accomplished by adjusting axial screws 229 to set the proper axial position. Additional adjustments controls can be added to adjustment ring assembly 220 if rotational adjustments are also desired.

Ramifications, and Scope

The disclosed Circular Weft Knitting Machine has many advantages over prior art for knitting hose reinforcement on rotating hoses. Being able to knit on a rotation hose allows for continuous production of certain types of hoses where multiple layers are molded in a rotary production, with the knitted reinforcement being one of these layers. The use of the disclosed knitting machine removes the common practice of rotating yarn packages (yarn spools) around the knitting head to reinforce hoses. Rotating the yarn packages require frequent changing of the yarn packages and also a heavy rotating platter to hold the weight of the yarn packages. Very heavy housing is also needed to protect works from the heavy platter and yarn packages rotating a high speed. Thus, by not requiring the yarn spools and feed equipment to rotate, a much small lighter and safer piece of equipment can accomplish the same task, without the need to stop production to reload spools of yarn.

Although the above description of the invention contains many specifications, these should not be viewed as limiting the scope of the invention. Instead, the above description should be considered illustrations of some of the presently preferred embodiments of this invention. For example, the style of the cylinder knitting head shown in Knitting Machines 140*a*, and 140*b* are just two examples of the many styles of Circular Weft Knitting Heads that could be use to provide the desired knitting process. For example, alternate knit heads can be use to provide more complex knit patterns than are possible with the basic one or two cam cylinder style Circular Weft Knitting Heads 160 and 160*b*. Also a large number of different Cam tracks can be used even within Knitting Heads 160 and 160*b* to provide different style knit patterns. Different numbers and styles of needles can be used to provide variation in the final reinforcement.

Thus, the scope of this invention should not be limited to the above examples but should be determined from the following claims.

I claim:

1. A manufacturing process for reinforcing a hose, comprising the steps of:

a) axially rotating an elongated hose having a interior passageway and an exterior surface;

b) guiding the elongated hose into a circular knitting machine comprising a plurality of knitting needles, a circular knitting head with a central channel and two or more yarn packages that remain substantially stationary with respect to the position of the circular knitting head;

c) rotating the circular knitting head in the same direction as the elongated hose;

d) knitting a reinforcement cover around the exterior surface of the rotating elongated hose with the circular knitting head, and e) conforming the reinforcement cover to the shape of the exterior surface of the elongated hose.

2. The manufacturing process in claim 1, further including the additional step:

f) covering or coating the reinforcement cover with a polymer layer.

3. The manufacturing process in claim 2, wherein the polymer layer also bonds with the reinforcement cover and/or the exterior surface of the elongated hose.

4. The manufacturing process in claim 3, wherein the elongated hose is a stretch hose having an extended length and a retracted length, and further including the step of stretching the stretch hose to its extended length prior to step d).

5. The manufacturing process in claim 1, wherein the elongated hose is a stretch hose having an extended length and a retracted length, and further including the step of stretching the stretch hose to its extended length prior to step d).

6. The manufacturing process in claim 1, wherein the circular knitting machine is a circular weft knitting machine, and wherein the knitting head of the circular weft knitting machine rotates in the same direction as the rotation of the elongated hose.

7. The manufacturing process in claim 6, wherein the elongated hose is a stretch hose having an extended length and a retracted length, and further including the step of stretching the stretch hose to its extended length prior to step d).

8. The manufacturing process in claim 1, wherein the circular knitting machine is a circular warp knitting machine, and wherein the knitting head of the circular warp knitting machine is non-rotating.

9. The manufacturing process in claim 8, wherein the elongated hose is a stretch hose having an extended length and a retracted length, and further including the step of stretching the stretch hose to its extended length prior to step d).

10. The manufacturing process in claim 1, wherein in step d), the circular knitting head is rotated slower than the rotation rate of the elongated hose.

11. The manufacturing process in claim 1, wherein in step d), the circular knitting head is rotated at the same rotation rate as the elongated hose.

12. The manufacturing process in claim 1, wherein in step d), the circular knitting head is rotated faster than the rotation rate of the elongated hose.

13. The manufacturing process in claim 1, wherein the elongated hose has an exterior surface that has a convoluted shape.

14. A circular knitting machine for knitting a plurality of yarns into a tubular reinforcement on a rotating hose, comprising:

a) a knitting head having a plurality of knitting needles and a central passageway, wherein the central passageway is designed to allow the rotating hose to pass therethrough, wherein the knitting head is designed for knitting the plurality of yarns into the tubular reinforcement onto the exterior of the rotating hose, wherein the knitting head is rotatable in the same direction of rotation as the rotating hose;

b) a actuation means in communication with the plurality of knitting needles for actuating the knitting needles in the proper sequence to produce the tubular reinforcement;

c) a rotary means in contact with the knitting head for providing rotational motion to the knitting head;

d) a plurality of spools feeding the plurality of yarns to the knitting head, wherein the plurality of spools do not rotate with the knitting head, and e) a conforming means defined on the circular knitting machine for conforming the tubular reinforcement to the exterior of the rotating hose.

15. The circular knitting machine in claim 14, further including a tensioning means mounted in relationship to the plurality of spools and designed for tensioning and guiding the plurality of yarns to the knitting head and plurality of knitting needles, wherein the tensioning means does not rotate with the knitting head.

16. The circular knitting machine in claim 14, wherein the actuation means comprises a cam assembly in communication with the knitting needles, wherein the cam assembly is substantially stationary.

17. The circular knitting machine in claim 14, wherein the rotating means is designed to provide a multiplicity of rotational speeds for the knitting head, wherein the rotational speed of the knitting head can be slower than, equal to, or faster than the rotation rate of the rotating hose.

18. The circular knitting machine in claim 14, wherein the rotating hose is a stretch hose having an extended length and a retracted length, and further including a stretching means in combination with the circular knitting machine for extending the rotating stretch hose to its extended length during the knitting of the tubular reinforcement.

19. A manufacturing process for manufacturing a reinforced hose, comprising the steps of:

a) coiling a wire into a tension spring and actively rotating the tension spring along its axis;

b) forming a first polymer layer over the axially rotating tension spring to form a rotating convoluted hose having a interior passageway and an exterior surface;

c) forming a reinforcement cover comprising a plurality of yarn strands over the exterior surface of the rotating convoluted hose, wherein there is a plurality of opens spaces in the reinforcement cover , and d) covering or coating the reinforcement cover with a second polymer layer while the hose is still rotating.

20. The manufacturing process in claim 19, further including the step of bonding the second polymer layer to the reinforcement cover and/or the exterior surface of the rotating convoluted hose through the plurality of open spaces.

21. The manufacturing process in claim 19, wherein the forming of the reinforcement in step c) is provided by a knitting head having a plurality of knitting needles and a central passageway, wherein the central passageway is designed to allow the rotating hose to pass therethrough, wherein the knitting head is designed for knitting the plurality of yarns into the tubular reinforcement onto the exterior of the rotating convoluted hose, wherein the knitting head is rotatable in the same direction of rotation as the rotating convoluted hose.

* * * * *